US005096430A

United States Patent [19]

D'Amico

[11] Patent Number: 5,096,430

[45] Date of Patent: Mar. 17, 1992

[54] COVERING ELECTRICAL SOCKETS FOR SAFETY

[76] Inventor: Ralph E. D'Amico, 30 High St., Medford, Mass. 02155-3820

[21] Appl. No.: 654,339

[22] Filed: Feb. 12, 1991

[51] Int. Cl.[5] ..... H01R 13/44

[52] U.S. Cl. ..... 439/148; 174/67; 439/142; 439/521

[58] Field of Search ..... 439/148, 142, 373, 521, 439/892; 174/66, 67

[56] References Cited

U.S. PATENT DOCUMENTS

| | | | |
|---|---|---|---|
| 1,003,391 | 9/1911 | Barber et al. | 439/148 |
| 2,728,894 | 12/1955 | Peters | 174/67 |
| 2,932,811 | 4/1960 | Abraham et al. | 339/38 |
| 3,387,252 | 6/1968 | Rothweiler | 339/38 |
| 3,389,367 | 6/1968 | Schwartz | 339/38 |
| 3,686,616 | 8/1972 | Bowerman | 339/38 |
| 3,876,273 | 4/1975 | Schwartz | 339/38 |
| 4,228,317 | 10/1980 | Cziment | 439/142 |
| 4,293,173 | 10/1981 | Tricca | 339/38 |
| 4,408,813 | 10/1983 | Koehler | 439/148 |
| 4,801,271 | 1/1989 | Piper | 439/148 |

FOREIGN PATENT DOCUMENTS

| | | |
|---|---|---|
| 729314 | 3/1966 | Canada . |
| 57888 | 1/1967 | German Democratic Rep. . |

*Primary Examiner*—Paula A. Bradley
*Attorney, Agent, or Firm*—Fish & Richardson

[57] ABSTRACT

A safety cover for covering a plurality of co-planar sockets of an electrical outlet includes a plurality of cover sections. Attached to each of the cover sections is at least one non-conductive prong configured for insertion into at least one receptacle opening of one of the sockets. A flexible interconnection strip interconnects at least a first of the cover sections with at least a second of the cover sections. The flexible interconnection strip has a rest configuration in which the flexible interconnection strip is positioned in a manner such that the first and second cover sections are substantially non-coplanar with respect to each other. A cam structure is attached to at least one of the cover sections. The cam structure and the prong are located on the same surface of the cover section. The cam structure is constructed and positioned to permit a user to apply downward pressure on the surface of the cover section that is opposite to the cam structure while the prong is located in the receptacle opening and thereby to cause the cover section to pivot about the cam structure and to cause the prong to withdraw at least partially from the receptacle opening. As an alternative to the cam structure, the cover sections may be constructed of soft, elastic material. The outer edges of each cover section form a seal around the socket while the prong is located in the receptacle opening and no pressure is applied to the center portion of the cover section. The outer edges of the cover section push outward from the socket when pressure is applied to the center portion.

34 Claims, 1 Drawing Sheet

COVERING ELECTRICAL SOCKETS FOR SAFETY

The present invention relates in general to covering electrical sockets for safety purposes and more particularly concerns safety covers for standard duplex electrical outlets.

Safety covers or guards for standard duplex outlets typically include a pair of plastic cover sections for covering each of the two sockets of the outlet. Attached to each of the cover sections is a pair of plastic prongs that are configured for insertion into the receptacle openings of the sockets. During periods of time in which no electrical plugs are plugged into the sockets, the plastic cover sections are plugged into the sockets in order to prevent the insertion, e.g. by children, of metal objects into the receptacle openings, which can cause electrocution.

If the cover sections are not interconnected, one of the cover sections may cover one of the sockets while an electrical plug is inserted into the other socket. If the cover sections are interconnected, the interconnection strip may be made of flexible material, in order to permit one of the cover sections to be retracted away from one of the sockets while the other cover section remains plugged into the other socket, thereby enabling an electrical plug to be plugged into one of the sockets while the other socket remains covered by a cover section. The flexible interconnection strip may be attached to the electrical outlet by means of the mounting screw in the center of the outlet, as described in U.S. Pat. No. 2,932,811.

A search of U.S. and foreign art in classes 439/148, 439/142, 439/136, 174/66, 174/67, and 174/52 uncovered the following additional patents that were noted as being pertinent to the present invention: U.S. Pat. Nos. 4,801,271, 4,408,813, 4,293,173, 3,876,273, 3,686,616, 3,389,367, and 3,387,252, Canadian patent 729,314, and East German patent 57,888.

It is an important object of the invention to provide an improved safety cover for electrical sockets.

According to one aspect of the invention, there is a safety cover for covering a plurality of co-planar sockets of an electrical outlet. The safety cover includes a plurality of cover sections. Attached to each of the cover sections is at least one non-conductive prong configured for insertion into at least one receptacle opening of one of the sockets. A flexible interconnection strip interconnects at least a first of the cover sections with at least a second of the cover sections. The flexible interconnection strip has a rest configuration in which the flexible interconnection strip is positioned in a manner such that the first and second cover sections are substantially non-co-planar with respect to each other. The rest configuration of the interconnection strip enables the first cover section to be plugged into and retracted away from a first socket with relative ease while the second cover section remains plugged into a second socket, and reduces any undesired tendency of the second cover section to retract away from the second socket with the retraction of the first cover section away from the first socket.

Preferably, there are two cover sections configured to cover two standard wall sockets of a standard duplex electrical wall outlet. Attached to each of the cover sections are two non-conductive prongs configured for insertion into the two receptacle openings of one of the sockets. In one embodiment, a tab is attached to the first cover section. The tab is arranged to permit a user to lift the tab in a direction away from the outlet, and thereby to lift the first cover section away from the first socket to remove the prongs from the receptacle openings of the first socket. The tab is co-planar with the first cover section and attached to the first cover section opposite a location at which the flexible interconnection strip is attached to the first cover section.

According to another aspect of the invention, a cam structure is attached to a cover section. The cam structure and the prong or prongs are located on the same surface of the cover section. The cam structure is constructed and positioned to permit a user to apply downward pressure on the surface of the cover section that is opposite to the cam structure while the prong or prongs are located in the receptacle opening or openings and thereby to cause the cover section to pivot about the cam structure and to cause the prong or prongs to withdraw at least partially from the receptacle opening or openings. Preferably, a cam structure and two prongs are attached to each of two interconnected cover sections.

According to another aspect of the invention, a cover section is constructed of soft, elastic material. The outer edges of the cover section form a seal around the socket while the prong or prongs are located in the receptacle opening or openings and no pressure is applied to the center portion of the cover section. The outer edges of the cover section push outward from the socket while the prong or prongs are located in the receptacle opening or openings and pressure is applied to the center portion of the cover section. The seal of the edges of the cover section against the socket makes it difficult for young children to remove the safety cover from the outlet. The seal also insulates the socket from drafts. Preferably, two such cover sections are interconnected into a single safety cover unit.

Numerous other features, objects, and advantages of the invention will become apparent from the following detailed description when read in connection with the accompanying drawings in which.

Figure 2:
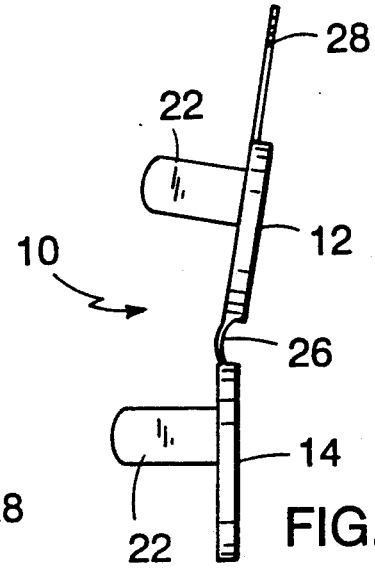
FIG. 2 is a side view of the safety cover of FIG. 1 as seen in its rest configuration.
Figure 3:
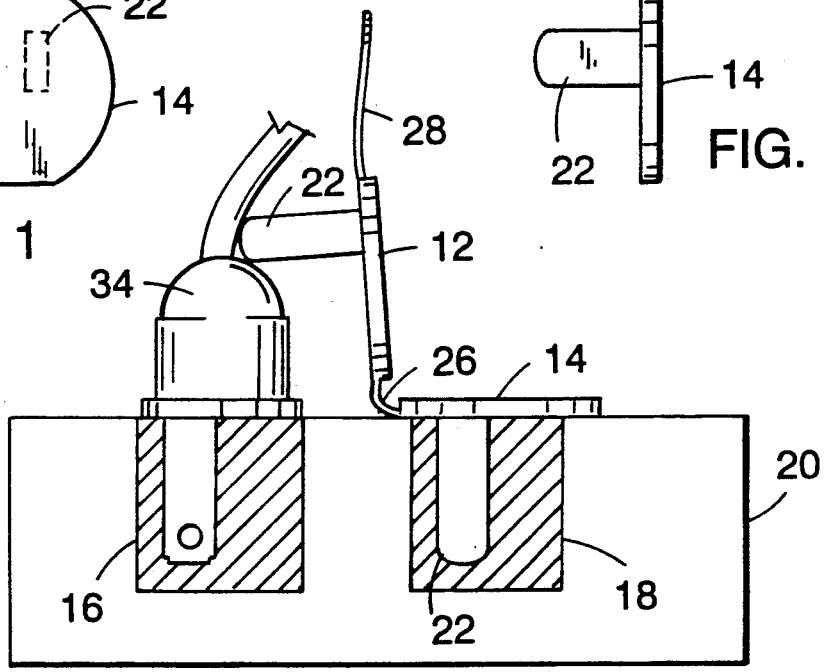
FIG. 3 is a side view of the safety cover of FIG. 1 with the prongs of one cover section plugged into a socket of a duplex outlet and the other cover section retracted away from the other socket to permit insertion of an electrical plug into the other socket.

With reference now to the drawings and more particularly FIGS. 2, and 3 thereof, safety cover 10 includes two plastic cover sections 12 and 14 for covering the two sockets 16 and 18 of standard duplex electrical outlet 20. Attached to each of the cover sections and formed integrally therewith is a pair of plastic prongs 22 constructed for insertion into the receptacle openings of the sockets. Plastic cover sections 12 and 14 are interconnected by flexible plastic interconnection strip 26, which has the rest configuration shown in FIG. 2. When interconnection strip 26 is in this rest configuration, cover sections 12 and 4 are substantially non-coplanar with each other. A plastic tab 28 is attached to cover section 12 to provide a means for retracting cover section 12 away from socket 16 while cover section 14 is plugged into socket 18.

Referring to FIG. 3, a user can protect sockets 16 and 18 of outlet 20 by positioning prongs 22 of safety cover 10 at the receptacle openings of the sockets and applying pressure to cover sections 12 and 14 to cause prongs 22 to be inserted into the receptacle openings. If the user subsequently wishes to insert an electrical plug 34 into socket 16, the user lifts tab 28 away from the outlet, causing cover section 12 to retract away from socket 16. Because interconnection strip 26 is flexible, cover section 14 can remain plugged into socket 18. Moreover, the rest configuration of interconnection strip 26 shown in FIG. 2 enables cover section 12 to be plugged into and retracted away from socket 16 with relative ease while cover section 14 remains plugged into socket 18, and reduces any undesired tendency of cover section 14 to retract away from socket 18 with the retraction of cover section 12 away from socket 16. If the user wishes to remove the entire safety cover 10 from electrical outlet 20, the user pulls on tab 28 to retract cover section 12 away from socket 16, and pulls further on tab 28 to retract cover section 14 away from socket 18 as well.

Figure 1:
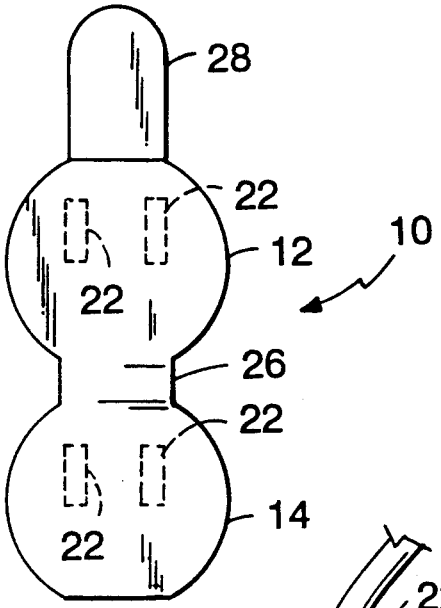
FIG. 1 is a drawing of a safety cover according to the invention.
Figure 4:
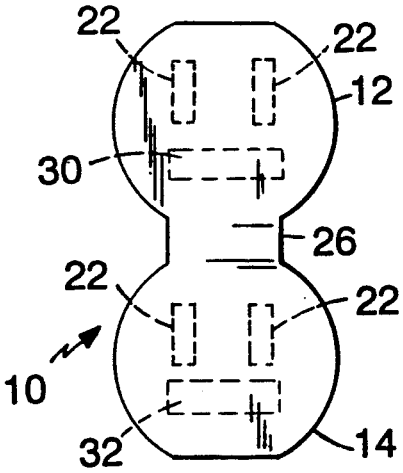
FIG. 4 is a drawing of another embodiment of a safety cover according to the invention.
Figure 5:
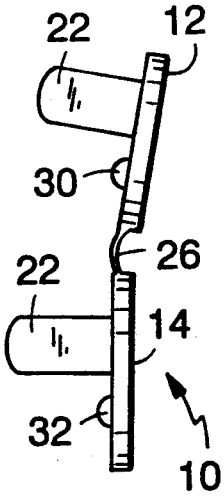
FIG. 5 is a side view of the safety cover of FIG. 4 as seen in its rest configuration.

Referring to FIGS. 4 and 5, in an alternative embodiment of the invention, small plastic cam structures 30 and 32 are attached to cover sections 12 and 14 respectively and formed integrally therewith. Cam structures 30 and 32 are constructed and positioned in a manner such that when a cover section 12 or 14 is plugged into a socket 16 or 18, a user can press on the portion of cover section 12 or 14 that is below cam structure 30 or 32 to cause cover section 12 or 14 to pivot about cam structure 30 or 32, thereby causing prongs 22 to retract away slightly from the receptacle openings. The user can then grasp cover section 12 or 14 by the edges and retract cover section 12 or 14 completely away from socket 16 or 18 to permit insertion of an electrical plug into the socket. Note that cam structures 30 and 32 eliminate the need for the tab 28 shown in FIGS. 1, 2, and 3. Cam structures 30 and 32 provide a convenient way to initiate the retraction of one of the cover sections away from one of the sockets without any sudden movement that could cause undesired retraction of the other cover section away from the other socket.

Figure 6:
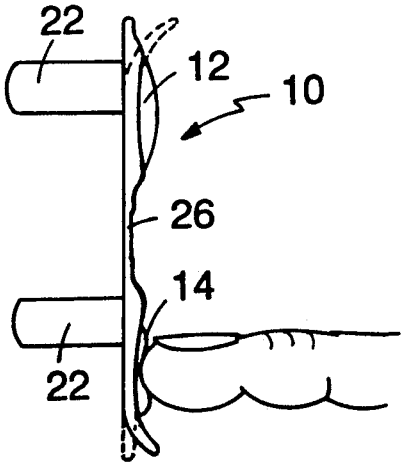
FIG. 6 is a side view of another embodiment of a safety cover according to the invention.

Referring to FIG. 6, in yet another embodiment of the invention, cover sections 12 and 14 are constructed of a soft, spring-like, elastic material that may be a plastic or rubber-like material. The outer edges of cover sections 12 and 14 form complete seals around the sockets while safety cover 10 is plugged into the sockets and no pressure is being applied to the center portions of the cover sections. The outer edges of each cover section push outward from the socket, however, as soon as pressure is applied to the center portion of the cover section. The user can then grasp cover section 12 or 14 by the edges and retract cover section 12 or 14 completely away from its respective socket to permit insertion of an electrical plug into the socket. The seal of the edges of the of the cover sections against the sockets provides additional security against children trying to remove the safety cover from the outlet, and also insulates the sockets from drafts.

There have been described novel and improved apparatus and techniques for covering electrical sockets to prevent insertion of metallic objects into the receptacle openings of the sockets. It is evident that those skilled in the art may now make numerous uses and modifications of and departures from the specific embodiment described herein without departing from the inventive concept. Consequently, the invention is to be construed as embracing each and every novel feature and novel combination of features present in or possessed by the apparatus and technique herein disclosed and limited solely by the spirit and scope of the appended claims.

What is claimed is:

1. A safety cover for covering a plurality of co-planar sockets of an electrical outlet, comprising a plurality of cover sections, each of said cover sections having attached thereto at least one non-conductive prong configured for insertion into at least one receptacle opening of a respective one of said co-planar sockets, and a flexible interconnection strip interconnecting at least a first of said cover sections with at least a second of said cover sections, said flexible interconnection strip having a rest configuration in which said flexible interconnection strip is positioned in a manner such that said first and second cover sections are substantially non-coplanar with respect to each other, wherein each of said cover sections is constructed of soft elastic material with the outer edges of a cover section forming a seal around the socket while the prong or prongs are located in the receptacle opening to inhibit removal of a cover section from a socket and help insulate the sockets from drafts.

2. A safety cover in accordance with claim 1, wherein each of said cover sections has attached thereto two non-conductive prongs configured for insertion into two respective receptacle openings of one of said sockets.

3. A safety cover in accordance with claim 1 and further comprising, said plurality of co-planar sockets, at least one of said cover sections being fastened to a respective one of said sockets, the sole means for securing a cover section to a socket being said non-conductive prongs.

4. A safety cover in accordance with claim 1, wherein there are two of said cover sections for covering two respective sockets.

5. A safety cover in accordance with claim 4, wherein said two cover sections are configured to cover two standard wall sockets of a standard duplex electrical wall outlet, and each of said cover sections has attached thereto two non-conductive prongs configured for insertion into two receptacle openings of a respective one of said standard wall sockets.

6. A safety cover in accordance with claim 1, further comprising a tab attached to said first cover section, said tab being arranged to permit a user to lift said tab in a direction away from said outlet, and thereby to lift said first cover section away from said first socket to remove said at least one prong away from said at least one receptacle opening of said first socket.

7. A safety cover in accordance with claim 6, wherein said tab is co-planar with said first cover section and attached to said first cover section opposite a location at which said flexible interconnection strip is attached to said first cover section.

8. A safety cover for covering a plurality of co-planar sockets of an electrical outlet, comprising a plurality of cover sections, each of said cover sections having attached thereto at least one non-conductive prong configured for insertion into at least one receptacle opening of a respective one of said co-planar sockets, and a flexible interconnection strip interconnecting at least a first of said cover sections with at least a second of said cover sections, said flexible interconnection strip having a rest configuration in which said flexible interconnection strip is positioned in a manner such that said first and second cover sections are substantially non-coplanar with respect to each other, wherein at least one of said cover sections has attached thereto a cam structure, said cam structure and said at least one prong being located on a same surface of said cover section, said cam structure being constructed and positioned to permit a user to apply downward pressure on a surface of said cover section opposite to said cam structure and said prong while said prong is located in said receptacle opening and thereby to cause said cover section to pivot about said cam structure and to cause said prong to withdraw at least partially from said receptacle opening.

9. A safety cover in accordance with claim 8, wherein each of said cover sections has attached thereto a cam structure.

10. A safety cover in accordance with claim 8, wherein each of said cover sections has attached thereto two non-conductive prongs configured for insertion into two respective receptacle openings of one of said sockets.

11. A safety cover in accordance with claim 8, wherein there are two of said cover sections for covering two respective sockets.

12. A safety cover in accordance with claim 11, wherein said two cover sections are configured to cover two standard wall sockets of a standard duplex electrical wall outlet, and each of said cover sections has attached thereto two non-conductive prongs configured for insertion into two receptacle openings of a respective one of said standard wall sockets.

13. A safety cover in accordance with claim 8, further comprising a tab attached to said first cover section, said tab being arranged to permit a user to lift said tab in a direction away from said outlet, and thereby to lift said first cover section away from said first socket to remove said at least one prong from said at least one receptacle opening of said first socket.

14. A safety cover in accordance with claim 13, wherein said tab is co-planar with said first cover section and attached to said first cover section opposite a location at which said flexible interconnection strip is attached to said first cover section.

15. A safety cover for covering a plurality of co-planar sockets of an electrical outlet, comprising a plurality of cover sections, each of said cover sections having attached thereto at least one non-conductive prong configured for insertion into at least one receptacle opening of a respective one of said co-planar sockets, and a flexible interconnection strip interconnecting at least a first of said cover sections with at least a second of said cover sections, said flexible interconnection strip having a rest configuration in which said flexible interconnection strip is positioned in a manner such that said first and second cover sections are substantially non-coplanar with respect to each other, wherein each of said cover sections has a center portion and outer edges, each of said cover sections being constructed of soft, elastic material and being constructed in a manner such that said outer edges form a seal around one of said sockets while said prong is located in said receptacle opening and no pressure is applied to said center portion of said cover section and such that said outer edges push outward from said one of said sockets while said prong is located in said receptacle opening and pressure is applied to said center portion.

16. A safety cover in accordance with claim 15, wherein each of said cover sections has attached thereto two non-conductive prongs configured for insertion into two respective receptacle openings of one of said sockets.

17. A safety cover in accordance with claim 15, wherein there are two of said cover sections for covering two respective sockets.

18. A safety cover in accordance with claim 17, wherein said two cover sections are configured to cover two standard wall sockets of a standard duplex electrical wall outlet, and each of said cover sections has attached thereto two non-conductive prongs configured for insertion into two receptacle openings of a respective one of said standard wall sockets.

19. A safety cover in accordance with claim 15, further comprising a tab attached to said first cover section, said tab being arranged to permit a user to lift said tab in a direction away from said outlet, and thereby to lift said first cover section away from said first socket to remove said at least one prong from said at least one receptacle opening of said first socket.

20. A safety cover in accordance with claim 19, wherein said tab is co-planar with said first cover section and attached to said first cover section opposite a location at which said flexible interconnection strip is attached to said first cover section.

21. A safety cover for covering at least one socket of an electrical outlet, comprising at least one cover section, at least two non-conductive prongs attached to said cover section, configured for insertion into at least two receptacle openings of said socket, and a cam structure attached to said cover section, said cam structure and said prongs being located on and protruding from a same surface of said cover section, said cam structure being constructed and positioned to permit a user to apply downward pressure on a surface of said cover section opposite to said cam structure and said prongs while said prongs are located in said receptacle openings and thereby to cause said cover section to pivot about said cam structure and to cause said prongs to withdraw at least partially from said receptacle openings.

22. A safety cover in accordance with claim 21, wherein each of said cover sections has attached thereto two non-conductive prongs configured for insertion into two respective receptacle openings of one of said sockets.

23. A safety cover in accordance with claim 21, wherein there are a plurality of cover sections for covering a plurality of respective sockets of an electrical outlet, and said safety cover further comprises an interconnection strip interconnecting at least a first of said cover sections with at least a second of said cover sections.

24. A safety cover in accordance with claim 23, wherein there are two of said cover sections for covering two respective sockets.

25. A safety cover in accordance with claim 24, wherein said two cover sections are configured to cover two standard wall sockets of a standard duplex electrical wall outlet, and each of said cover sections has attached thereto two non-conductive prongs configured for insertion into two receptacle openings of a respective one of said standard wall sockets.

26. A safety cover in accordance with claim 21, wherein there are two of said cover sections for covering two respective sockets.

27. A safety cover in accordance with claim 26, wherein said two cover sections are configured to cover two standard wall sockets of a standard duplex electrical wall outlet, and each of said cover sections has attached thereto two non-conductive prongs configured for insertion into two receptacle openings of a respective one of said standard wall sockets.

28. A safety cover in accordance with claim 21, further comprising a tab attached to said first cover section, said tab being arranged to permit a user to lift said tab in a direction away from said outlet, and thereby to lift said first cover section away from said first socket to remove said at least one prong from said at least one receptacle opening of said first socket.

29. A safety cover in accordance with claim 28, wherein said tab is co-planar with said first cover section and attached to said first cover section opposite a location at which said flexible interconnection strip is attached to said first cover section.

30. A safety cover for covering at least one socket of an electrical outlet, comprising at least one cover section, and at least one non-conductive prong attached to said cover section, configured for insertion into at least one receptacle opening of said socket, said cover section having a center portion and outer edges, said cover section being constructed of soft, elastic material and being constructed in a manner such that said outer edges form a seal around said socket while said prong is located in said receptacle opening and no pressure is applied to said center portion of said cover section and such that said outer edges push outward from said socket while said prong is located in said receptacle opening and pressure is applied to said center portion.

31. A safety cover in accordance with claim 30, wherein said at least one cover section has attached thereto two non-conductive prongs configured for insertion into two respective receptacle openings of said socket.

32. A safety cover in accordance with claim 30, wherein there are a plurality of cover sections for covering a plurality of respective sockets of an electrical outlet, each of said cover sections has attached thereto at least one non-conductive prong configured for insertion into at least one receptacle opening of a respective one of said sockets, and said safety cover further comprises an interconnection strip interconnecting at least a first of said cover sections with at least a second of said cover sections.

33. A safety cover in accordance with claim 30, wherein there are two of said cover sections for covering two respective sockets.

34. A safety cover in accordance with claim 33, wherein said two cover sections are configured to cover two standard wall sockets of a standard duplex electrical wall outlet, and each of said cover sections has attached thereto two non-conductive prongs configured for insertion into two receptacle openings of a respective one of said standard wall sockets.

* * * * *